United States Patent [19]

Sarkozi

[11] Patent Number: 5,009,417

[45] Date of Patent: Apr. 23, 1991

[54] ABDOMINAL EXERCISE DEVICE

[76] Inventor: Jeff Sarkozi, 1117 N. Avila Pl., Orange, Calif. 92669

[21] Appl. No.: 561,337

[22] Filed: Jul. 31, 1990

[51] Int. Cl.[5] ..... A63B 23/02

[52] U.S. Cl. ..... 272/145; 5/508; 5/443

[58] Field of Search ..... 5/431, 444, 443, 327 R; 272/145, 144, 92, 72, 900; 128/829, 82, 80, 83, 84; 269/322, 324

[56] References Cited

U.S. PATENT DOCUMENTS

| | | | |
|---|---|---|---|
| 695,538 | 3/1902 | Clairmont | 272/145 |
| 914,785 | 3/1909 | Boyce | 128/869 |
| 2,834,032 | 7/1956 | Scott | 5/443 |
| 3,173,152 | 3/1965 | Maples | 5/444 |
| 4,515,361 | 5/1985 | Melillo et al. | 272/93 |

*Primary Examiner*—R. J. Apley
*Assistant Examiner*—Jerome W. Donnelly
*Attorney, Agent, or Firm*—Willie Krawitz

[57] ABSTRACT

A portable exercise device for strengthening abdominal muscles is provided which can be operated by an individual exercising on a mattress and box spring, or the like combinaton, without requiring additional assistance during the exercise routine. The device may be easily unfolded for use, and following use, it may be refolded and conveniently stored. The device at one end is folded for securement between the mattress and the box spring, and unfolds and overlays the upper portion of the mattress for use by the individual. The device is adapted to fold and conform with the user's bent ankles, knees and hips, and these folds correspond to the fold lines for folding and unfolding the device. Foot securement means are employed to stabilize the user's feet, and this eliminates the need for assistance during the exercise program. The device at the opposite end lies on the mattress and includes a sheet material upon which the user rests, and the weight of the user on the sheet anchors the device on the mattress and prevents it from slipping or becoming displaced during use.

10 Claims, 2 Drawing Sheets

ABDOMINAL EXERCISE DEVICE

BACKGROUND OF THE INVENTION

This invention relates to an exercise device for strengthening abdominal muscles, and more specifically to a device which may be employed by a user without requiring assistance. The device is primarily employed in conjunction with a mattress and box-spring, and combined with its foldable and portable structure, enables it to be readily used in the home with various mattress sizes, as well as under a door, etc., and also may be carried on trips for use outside the home such as in hotels, etc.

Strengthening the abdominal muscles, and hence the support of the lower back, results in fewer back problems and also improves posture and overall fitness. Usually, some assistance is required to hold the user's feet stationary while an abdominal exercise such as a sit-up exercise is being performed. Typical patents in this field include U.S. Pat. Nos. 2,240,228; 3,134,592; 4,378,939; 4,508,335; 4,515,361; 4,550,907; 4,679,788; German patent 2,145,884; and Japan Patent 57-93354. The devices which are considered to produce the most effective results are those where the user can place both hands behind the head while securing the feet with some type of holding means and then performing a sit-up exercise. Preferably, an abdominal exercise device should accomplish the following: i. the user's knees and hips are bent or flexed; ii. the user's feet are anchored; iii. no irritation of the tail bone should occur; iv. the device should be inexpensive and portable; and, v. the abdominal exercise should be capable of being performed with a graded degree of difficulty.

U.S. Pat. Nos. 3,134,592; 4,515,361; and, 4,679,788 describe devices which can be used in conjunction with a mattress and box-spring, but the devices of these patents are not readily portable, or lightweight, and assembling and disassembling these devices would be time consuming. Also, these devices appear to require expensive components.

An exercise device is desired which can be used in the home and which can be readily assembled, or disassembled and stored. Also a portable device is desired which can be used away from the home in conjunction with a mattress and box-spring, or on a carpet, floor, etc., for example in a hotel.

THE INVENTION

According to the invention, a device is provided for exercising the abdominal muscles by a user and which may be employed in conjunction with a mattress and a lower flat surface such as a box-spring, flat board, floor, and the like. The device comprises a foldable sheet, one end of the sheet being insertable for securement between the mattress and the board or box-spring, etc., at the foot end thereof. The sheet is then foldable over the foot end of the mattress upward to the upper surface of, or beyond the mattress, and then folds downwardly onto contact with the mattress, thereby forming a foot support area. Foot securement means are mounted on the device adjacent to or on the foot support area. Extending from the foot support area is an upwardly folded portion to conform with the user's ankles and calves, and beyond this sheet is a downwardly folded portion to conform with the user's thighs to produce flexion at the knee and hip area. The device then extends along the mattress and underlies the user's body.

Consequently, when resting on the device, the user's feet will be secured by the foot securement means, and hence, use of an assistant for this purpose is not be required. Also, when the user's legs are bent by the upwardly folded portion of the device, and with the user's arms folded behind the head, an optimum positioning of the entire body is provided for a sit-up exercise. Since the user's body is resting on the extended portion of the device, it will remain reasonably stationary on the mattress surface during the exercise.

The foldable capability of the device enables it to be easily folded along the fold lines following use, and the device can then be easily stored, and its portability features enables it to be carried and used outside the home.

Finally, the device of this invention may typically be constructed of inexpensive materials such as cardboard, compressed paper, plastic, fiberglass, wood, chipboard, compressed wood, compressed fiber products, aluminum, sheet metal, etc., or a combination thereof, while the manufacture itself is relatively inexpensive and does not involve complicated equipment or highly skilled workers.

DESCRIPTION OF THE PREFERRED EMBODIMENTS

Figure 1:
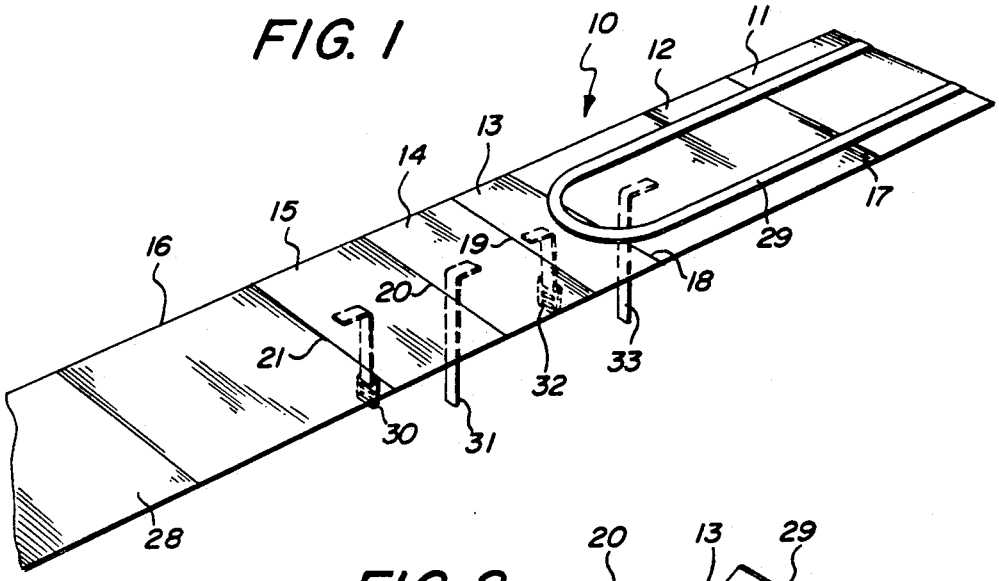
FIG. 1 is an upper perspective view of the exercise device of this invention showing the device when unfolded.
Figure 2:
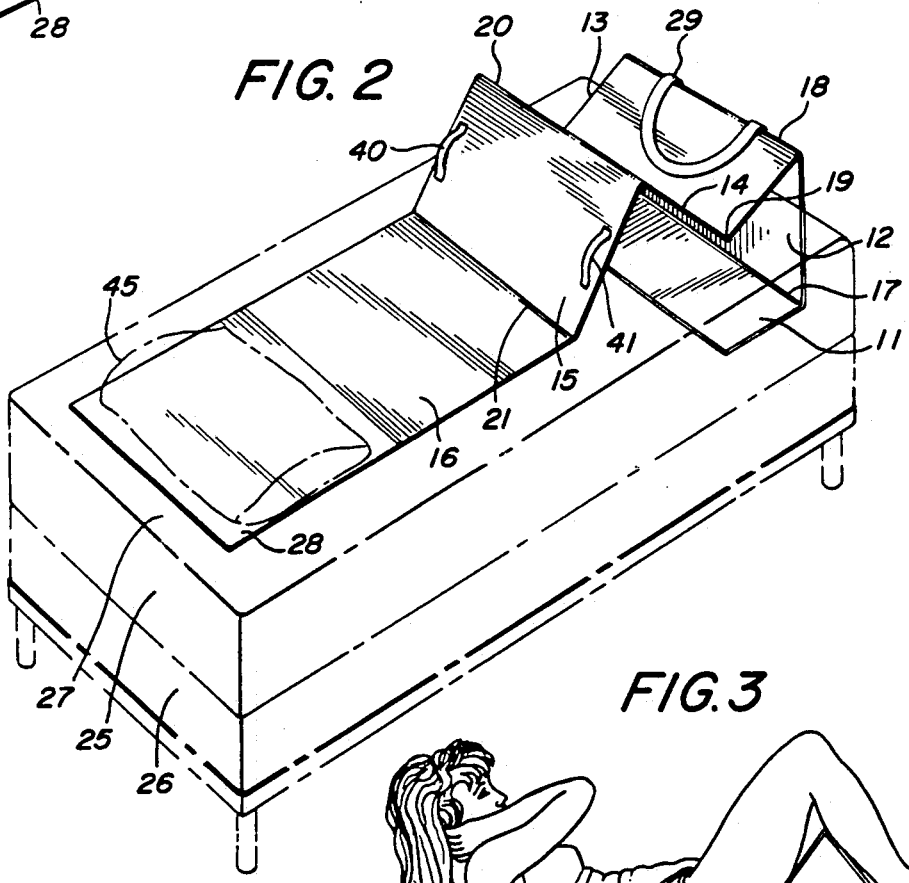
FIG. 2 is an external perspective view of the device folded for use and mounted on a mattress and box-spring.
Figure 3:
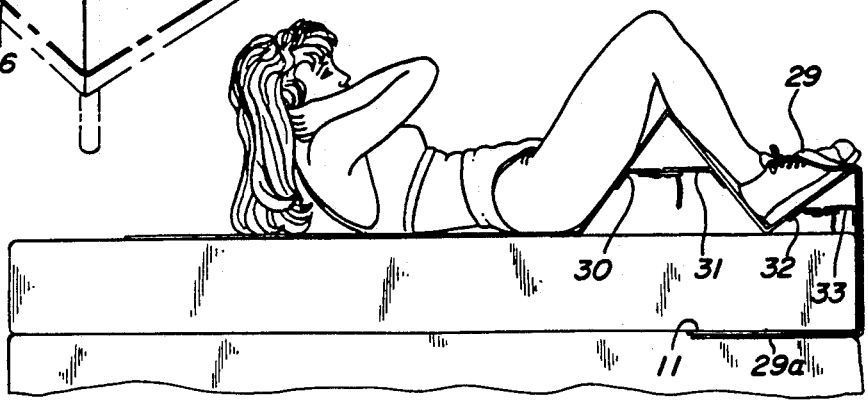
FIG. 3 is a sectional view in side elevation showing the device in use.

The abdominal exercise device 10 of this invention shown in FIGS. 1, 2 and 3 comprises a plurality of foldable sheet elements 11, 12, 13, 14, 15 and 16, about 1 foot to about 3 feet in width, that are joined along fold lines 17, 18, 19, 20 and 21. As shown in FIG. 2, the device is mounted on a mattress 25 and a box-spring 26, with sheet element 11 lying between the mattress and the box-spring to weight down the device and secure it in place at one end. Sheet element 12 folds upwardly from sheet element 11 along the fold line 17 and extends over the top of the mattress where it is joined to sheet element 13 along fold line 18. Sheet element 13 projects downwardly into contact with the upper portion 27 of the mattress along the fold line 19. If desired, fold lines 18, 19 and 20 may be sufficiently stiff to obviate use of support straps.

Leg conforming sheet elements 14 and 15 are joined along fold line 20, with sheet 14 being joined to sheet element 13, along fold line 19. As shown in FIGS. 2 and 3, sheets 14 and 15 are bent upwardly to form an inverted support rest that conforms to the bend of a user's legs during an exercise program.

The sheet elements 14, 15 are supported on the upper portion of the mattress by fold lines 19 and 21, and sheet element 16 is joined to sheet 15 along fold line 21. When using sheets constructed of an inflexible material such as hard plastics, wood or chipboard, the fold lines 17–21 may be hinged. Sheet element 16 lies flat on the upper portion 27 of the mattress, and extends into an end piece 28 which may be the same material, but not necessarily identical to the antecedent sheets, supra, or it may be a fabric material, etc. The end piece 28 extends from about the user's lower back to about the user's shoulders; sheet element 16 and end piece 28 function as a body rest to stabilize the device when in use.

Foot securement means such as a foot strap 29 is mounted onto sheet 12, and the free end extends onto sheet 13. The foot strap 29 may be further secured by extending one end 29*a* and attaching to sheet 11, thereby additionally securing the end 29*a* between the mattress 25 and the box spring 26, and the like, as shown in FIG. 3. The foot strap 29 may be mounted onto the sheets 11, 12 by heat sealing, adhesives, sewing, stapling, etc., depending on the materials of construction. Alternatively, a foot strap (not shown) may be mounted across the width of sheet 13.

When the device is partly unfolded for use, the sheet elements 12 and 13, 14 and 15 may be secured with respect to each other and are fixed in position by means of support straps 30, 31 and 32, 33 respectively. The attachment of the straps to each other can be accomplished by velcro, buckles, hook elements, etc., and the support straps are attached to the sheets in a similar manner as foot securement strap 29. Alternatively, sheets 12 and 13, 14 and 15 may be stabilized with respect to each other by means of a loop connected and secured through adjacent sheets (not shown).

When in use, as shown in FIG. 3, an individual will lie on the device, with the upper torso generally resting on the extension 28 and sheet element 16. The legs of the user rest and bend at the knees around sheets 14 and 15, while the user's feet engage and are secured by foot strap 29, and the feet resting on sheet 13. The individual can then perform a graded variety of sit-up exercises with the hands and arms positioned anywhere from the side of the body to behind the head, thereby allowing adjustment for the individual's center of gravity. This will subsequently provide a wide degree of latitude in the amount of resistance against the abdominal muscles during the sit-up exercise.

Hand grips 40 and 41 may be attached on either side of the device on sheet 15 to assist the user and enable a less demanding exercise level. The hand grips may be constructed of materials similar to the foot securement device 29, and are similarly attached to the device. 10. Alternatively, sheet 15 may be configured to provide hand grips (not shown).

In terms of a graded exercise level, a pillow or foam support 45, shown in dotted designation may be mounted on or under sheet 28 to provide a back support for the user and enable a sit-up to be performed commencing from a semi-reclining position, rather than a fully supine position.

Figure 4:
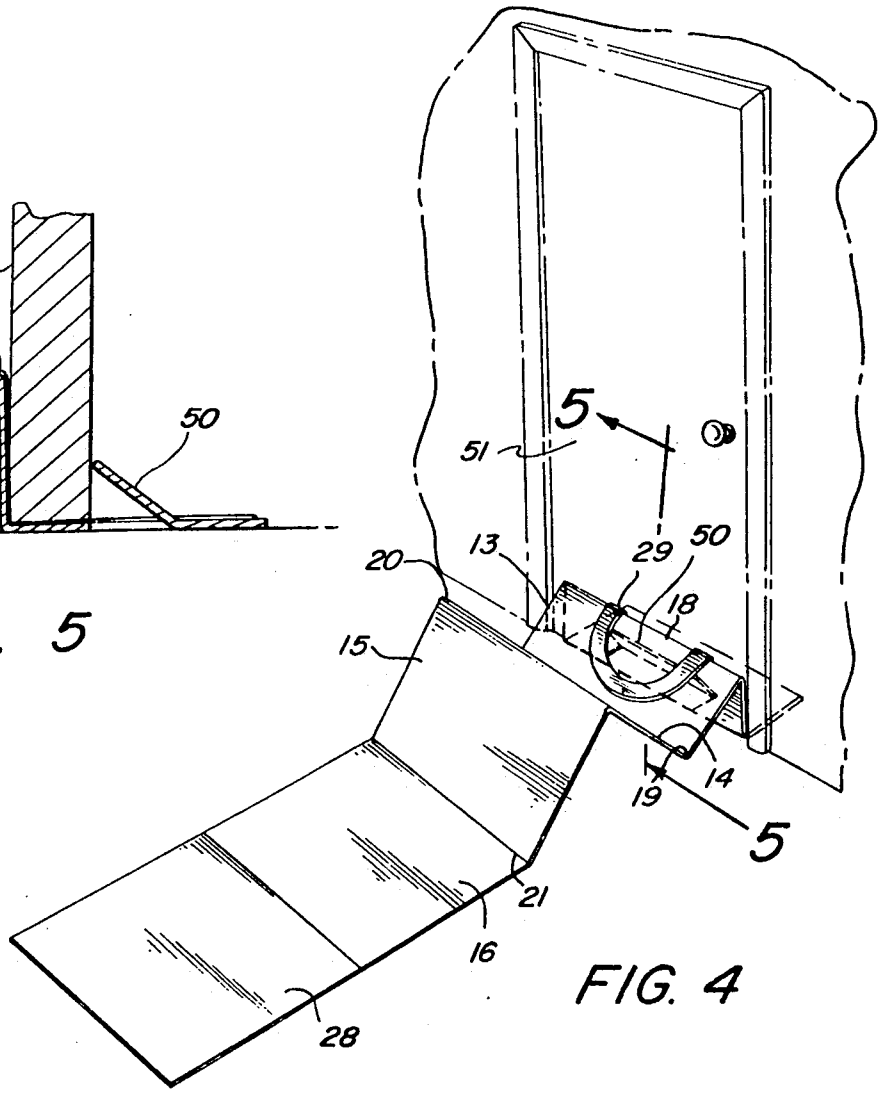
FIG. 4 is a sectional view in side elevation showing another means for securing the device; and, FIG. 5 is a sectional view in side elevation taken along lines 5—5 of FIG. 4.
Figure 5:
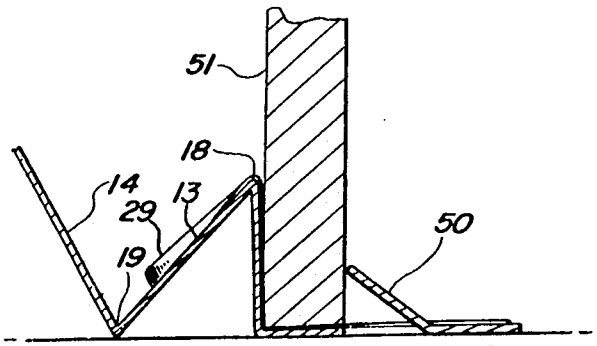

FIG. 4 shows the device 10 on a floor or carpet, without requiring a mattress, and used in conjunction with a door 51, furniture item, etc., for securing one end of the device. For this purpose the device is provided with a retainer or flap 50. The retainer can be molded onto or integrally formed with sheets 11 or 12. In use, the flap bears against the door to prevent backward movement of the device.

An individual can thus perform graded sit-up exercises commencing from a partly assisted exercise using the hand grips 40 and 41, and the cushion 45, to using the cushion without the hand grips, and finally to performing the sit-up from a completely supine position. In the semi-reclined or supine position, the intensity of the sit-up can be progressively increased as the individual positions the arms from the side of the body to extending the arms behind the head, and also by increasing the number and speed of the exercise.

When the exercise has terminated, the device can be easily removed from the mattress and box-spring or the like, or door, etc., and then be folded and stored. Its ease of portability enables it to be carried to another location, and used where convenient. It will be appreciated that the fold lines employed while the device is being used are the same as the fold lines used to fold up and store or carry the device. Also, the device may be used in a variety of ways depending on the physical condition of the user, and the amount of exercise desired.

It will be appreciated that various embodiments of this invention can be produced without departing from the basic spirit thereof. For example, the device may be coated and/or encased with a foam or soft fill material to provide a softer base and a more durable construction.

I claim:

1. A portable exercise device for strengthening abdominal muscles and the like of a user, for use on a mattress and box-spring comprising: a plurality of sheet elements serially attached along fold liens having a first end and a second end; said second end comprising at least a plurality of sections one of which is sufficiently long enough to support the thigh portion of the leg and a second attached sheet which is sufficiently long enough to support the lower legs; said second end further comprising a foot securement means located and attached within the plurality of sheets designated as the second end, said first end comprising a body sheet serially attached along a fold line to the second end of the device; whereby, the exercise device is adapted for unfolding along the fold lines and assembly with the mattress and box-spring; for use in a sit-up exercise mode; for removal of the device from the mattress and box-spring; for folding up; and, for carrying or storage.

2. The exercise device of claim 1, providing an end extension of the device supported on the mattress, and upon which the user rests, the weight of the user on the end extension being sufficient to stabilize the device against movement along the mattress, when in use.

3. The exercise device of claim 2, in which the device is folded up along the said fold lines.

4. The exercise device of claim 1, in which hand grip means are provided on the device for assisting in performing a sit-up exercise.

5. The exercise device of claim 1, in which the said fold lines are sufficiently stiff to enable the said sheets to retain a suitable shape during use.

6. The exercise device of claim 1, in which the fold lines are hinged to impart sufficient stiffness between the sheets thereby enabling the sheets to retain a suitable shape during use.

7. The exercise device of claim 1, in which the said sheets are constructed of materials selected from the class consisting of: cardboard, compressed paper, compressed wood, compressed fiber products, plastic, fiberglass, wood, chipboard, sheet metal, aluminum and combinations thereof.

8. The exercise device of claim 1, in which the device is provided with a stop means at a foot end thereof, and the foot end is adapted for insertion under a door, and the like, the stop functioning to prevent backwards motion of the device during a sit-up exercise.

9. The exercise device of claim 1, providing a coating or encasement with a material selected from foam and soft fill.

10. The exercising device of claim 1 comprising stabilizing support strap means connecting adjacent sheet elements within the plurality of sheets designated as the second end, the said support strap means being adapted to maintain the said adjacent sheet elements in an inverted and stabilized position, where required during an exercising period.

* * * * *